US008113995B1

(12) United States Patent
Hsu

(10) Patent No.: US 8,113,995 B1
(45) Date of Patent: Feb. 14, 2012

(54) ELLIPTICAL EXERCISE MACHINE WITH ADJUSTABLE STRIDE

(75) Inventor: Eric Hsu, Taipei County (TW)

(73) Assignee: Limax International, Inc (TW)

( * ) Notice: Subject to any disclaimer, the term of this patent is extended or adjusted under 35 U.S.C. 154(b) by 0 days.

(21) Appl. No.: 13/109,068

(22) Filed: May 17, 2011

Related U.S. Application Data

(63) Continuation-in-part of application No. 12/985,390, filed on Jan. 6, 2011.

(51) Int. Cl.
*A63B 22/04* (2006.01)
*A63B 22/00* (2006.01)

(52) U.S. Cl. ..... 482/52; 482/51

(58) Field of Classification Search ..... 482/51–53, 482/57, 70, 71, 79, 80
See application file for complete search history.

(56) References Cited

U.S. PATENT DOCUMENTS 6,152,859 A * 11/2000 Stearns ..... 482/52
6,277,056 B1 * 8/2001 McBride et al. ..... 482/57
6,645,125 B1 * 11/2003 Stearns et al. ..... 482/52
6,648,800 B2 * 11/2003 Stearns et al. ..... 482/52
7,097,591 B2 * 8/2006 Moon ..... 482/52
7,468,021 B2 * 12/2008 Moon ..... 482/52
7,604,573 B2 * 10/2009 Dalebout et al. ..... 482/52
7,811,207 B2 * 10/2010 Stearns et al. ..... 482/52
2006/0234838 A1 * 10/2006 Dalebout et al. ..... 482/57
2008/0261777 A1 * 10/2008 Chuang et al. ..... 482/52

* cited by examiner

*Primary Examiner* — Allana Lewin
(74) *Attorney, Agent, or Firm* — Tessari Patent Law Group

(57) ABSTRACT

An elliptical exercise machine includes two swing rods connected pivotally to a base, a flywheel, two supporting rods connected pivotally between the flywheel and the swing rods, two pedal rods slidable respectively on the supporting rods, and a motion transmitting device. The device includes a fixed member fixed on the base, a rotatable member locked releaseably on the fixed member at a selected angular position, two cranks connected pivotally to the rotatable member, and two links each having a first pivot portion connected pivotally to the corresponding pedal rod, a second pivot portion connected pivotally to the corresponding swing rod, and a third pivot portion connected pivotally to the corresponding crank. The links are driven by the cranks to move the pedal rods forwardly and rearwardly on the supporting rods, respectively.

9 Claims, 15 Drawing Sheets

ELLIPTICAL EXERCISE MACHINE WITH ADJUSTABLE STRIDE

CROSS-REFERENCE TO RELATED APPLICATION

This application is a continuation-in-part of U.S. patent Ser. No. 12/985,390, filed on Jan. 6, 2011.

BACKGROUND OF THE INVENTION

1. Field of the Invention

This invention relates to an exercise apparatus, and more particularly to an elliptical exercise machine with adjustable stride.

2. Description of the Related Art

Various stride adjustable elliptical exerciser machines have been proposed to meet the consumer's needs. For example, Taiwanese patent Number M286688 discloses an elliptical exerciser machine including a threaded rod and a threaded sleeve that engages the threaded rod. Relative rotation between the threaded rod and the threaded sleeve results in a change in a maximum distance between two pedals. Such a stride-adjusting arrangement, however, is complicated in structure, and is difficult to adjust.

SUMMARY OF THE INVENTION

The object of this invention is to provide a stride adjustable elliptical exercise machine that has a simple structure and that is easy to adjust.

Accordingly, an elliptical exercise machine of this invention includes two swing rods connected pivotally to a base, a flywheel, two supporting rods connected pivotally between the flywheel and the swing rods, two pedal rods slidable respectively on the supporting rods, and a motion transmitting device. The device includes a fixed member fixed on the base, a rotatable member locked releaseably on the fixed member at a selected angular position, two cranks connected pivotally to the rotatable member, and two links each having a first pivot portion connected pivotally to the corresponding pedal rod, a second pivot portion connected pivotally to the corresponding swing rod, and a third pivot portion connected pivotally to the corresponding crank. The links are driven by the cranks to move the pedal rods forwardly and rearwardly on the supporting rods, respectively.

BRIEF DESCRIPTION OF THE DRAWINGS

These and other features and advantages of this invention will become apparent in the following detailed description of two preferred embodiments of this invention, with reference to the accompanying drawings, in which.

DETAILED DESCRIPTION OF THE PREFERRED EMBODIMENTS

Figure 1:
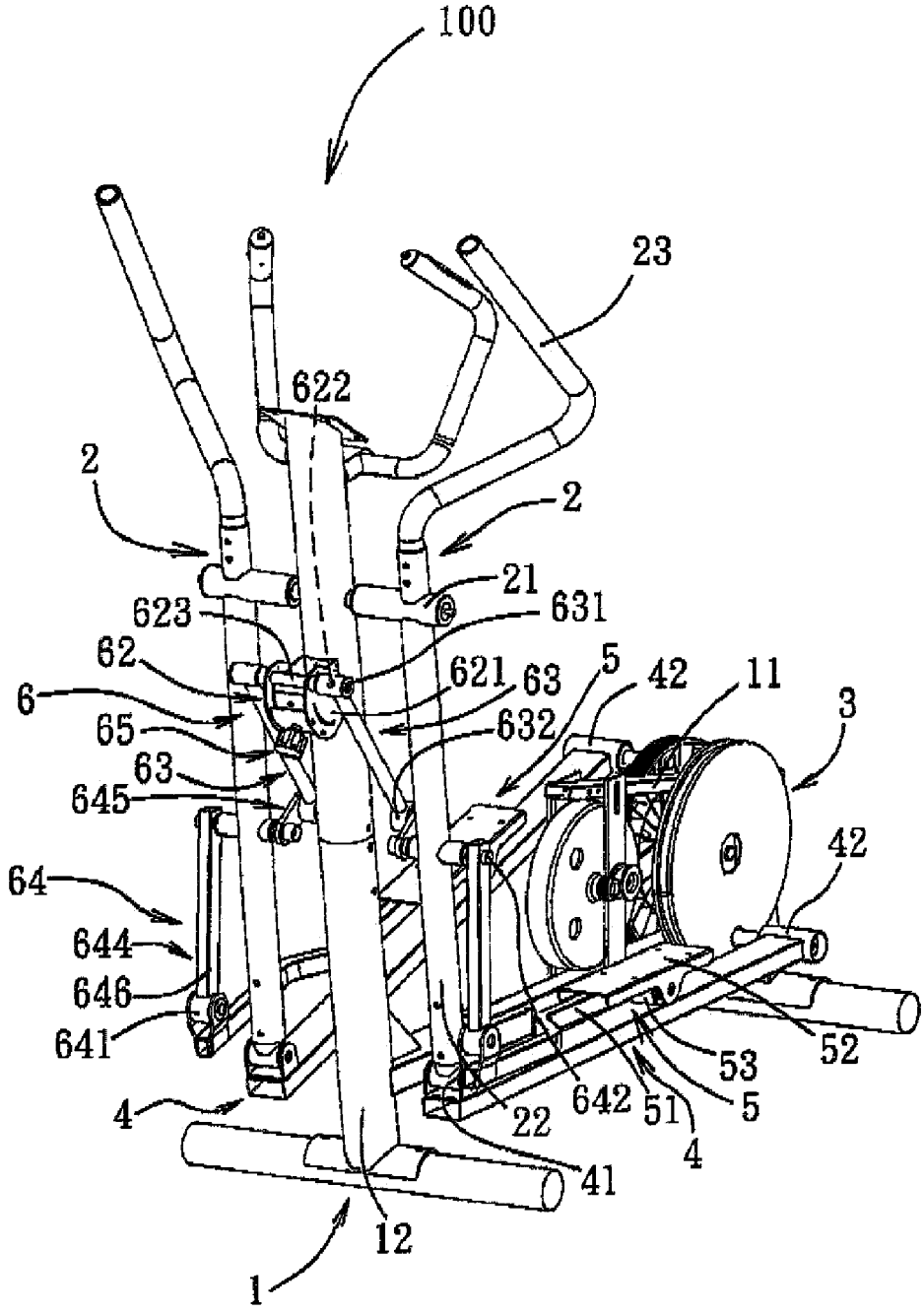
FIG. 1 is a front perspective view of the first preferred embodiment of a stride adjustable elliptical exercise machine according to this invention.
Figure 2:
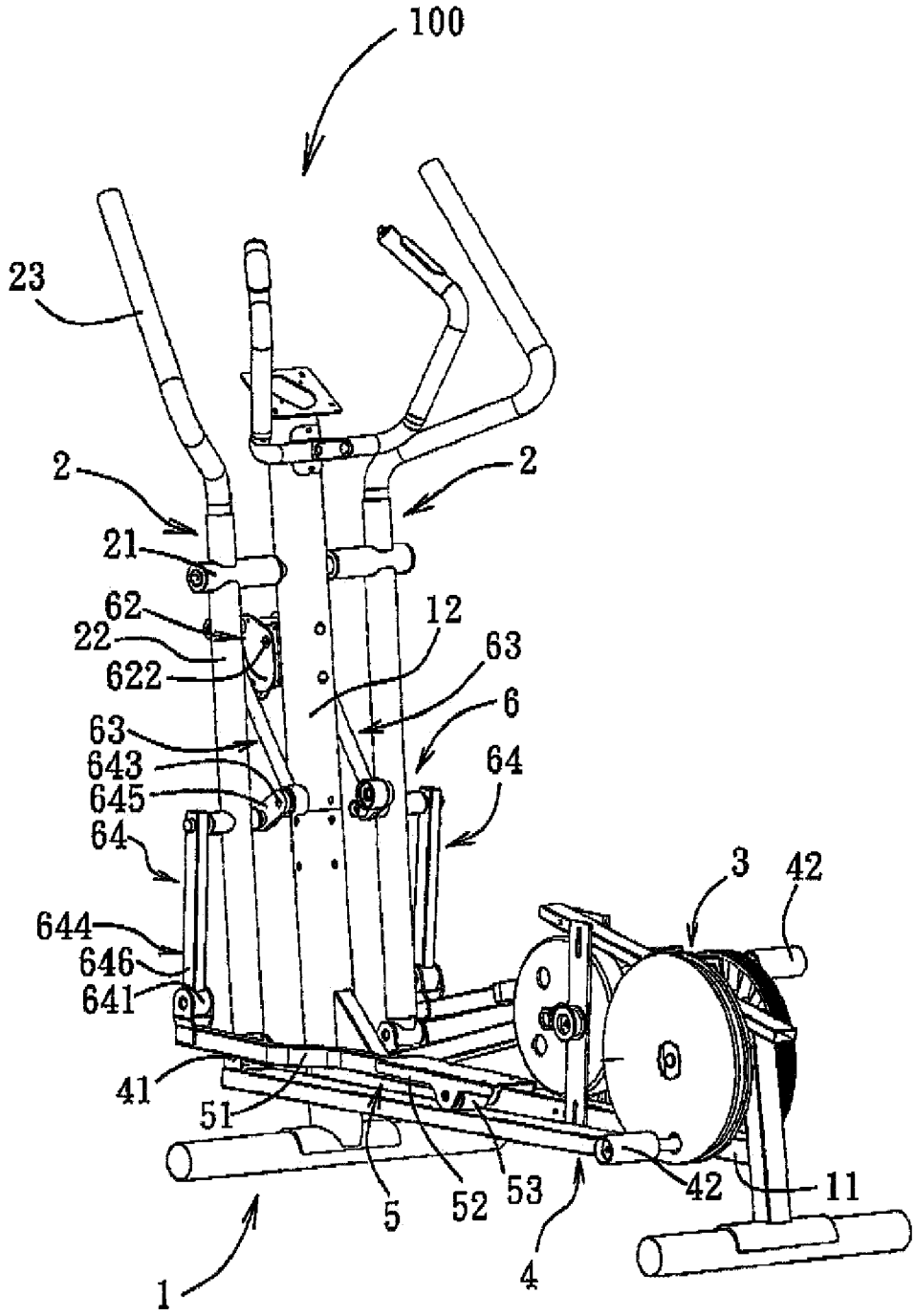
FIG. 2 is a rear perspective view of the first preferred embodiment.

Referring to FIGS. 1 and 2, the first preferred embodiment of a stride adjustable elliptical exercise machine 100 according to this invention includes a base 1, two swing rods 2, a flywheel 3, two supporting rods 4, two pedal rods 5, and a motion transmitting device 6.

Figure 3:
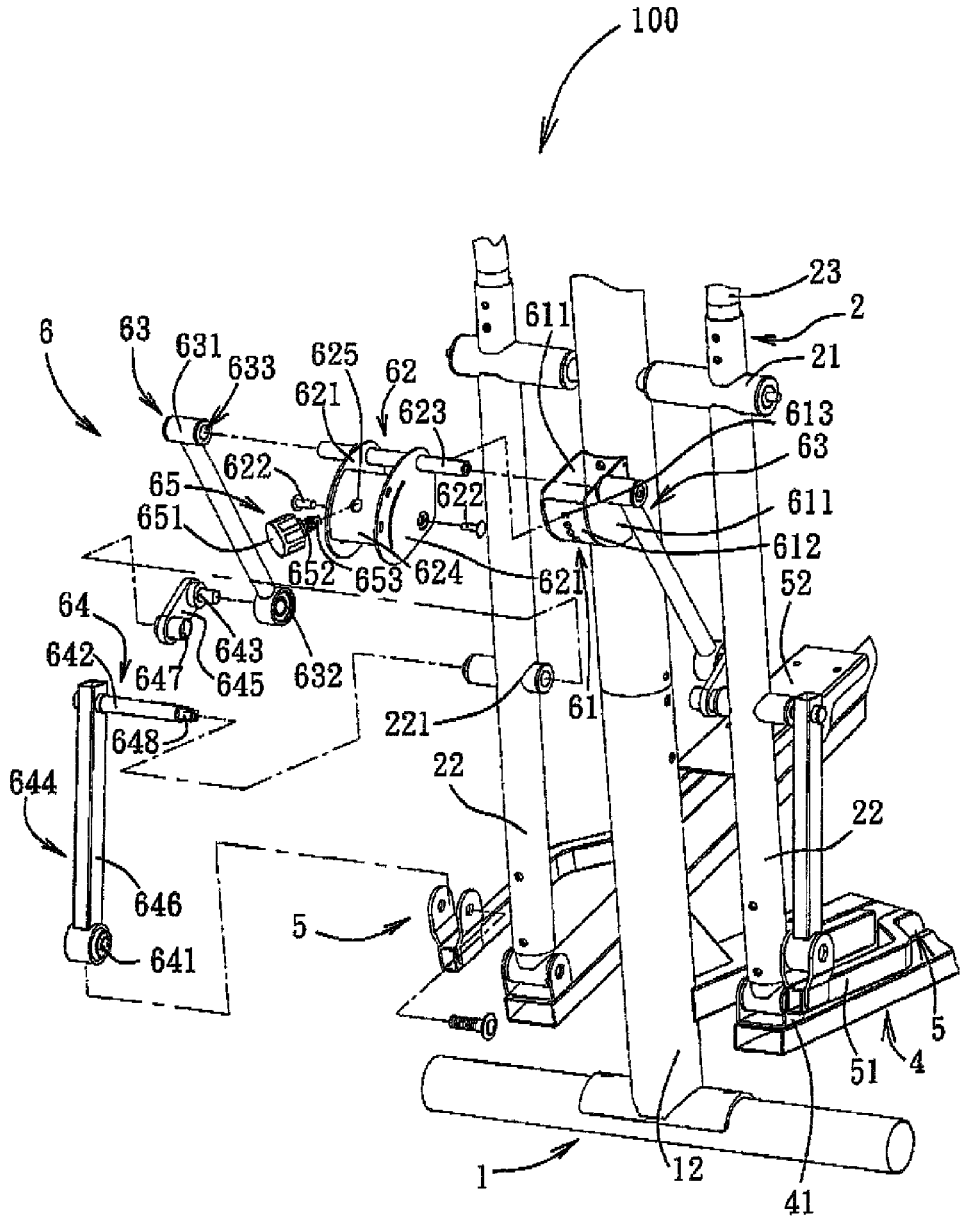
FIG. 3 is a partly exploded perspective view of the first preferred embodiment.

With further reference to FIG. 3, the base 1 is disposed on a supporting surface, such as the ground surface, and includes a main body 11, and a post 12 disposed fixedly on a front end of the main body 11. The swing rods 2 are connected pivotally to the base 11, and are spaced apart from each other in a left-to-right direction. Each of the swing rods 2 includes a horizontal pivot rod portion 21 connected rotatably on the post 12, an upright rod portion 22 extending perpendicularly from and disposed under the horizontal pivot rod portion 21, and a grip portion 23 extending from and disposed above the horizontal pivot rod portion 21 and aligned with the upright rod portion 22. As such, the grip portions 23 can be operated to pivot the upright rod portions 22 forwardly and rearwardly about the horizontal pivot rod portions 21.

The flywheel 3 is disposed rotatably on a rear end portion of the base 11. Each of the supporting rods 4 is straight, and has a front end 41 connected pivotally to a bottom end of the upright rod portion 22 of the corresponding swing rod 2, and a rear end 42 is slightly higher than the front end 41 and connected pivotally to the flywheel 3. The rear ends 42 of the two supporting rods 4 are connected respectively and pivotally to two opposite sides of the flywheel 3. The pedal rods 5 are disposed respectively on top surfaces of the supporting rods 4 for permitting the feet of the user to step thereon such that, when the flywheel 3 is rotated, each of the feet is moved in an elliptical path of motion simulating natural walking or running foot movement.

The motion transmitting device 6 includes a fixed member 61 and a rotatable member 62. The fixed member 61 is disposed fixedly on and in front of the post 12, and includes two vertical sidewalls 611 spaced apart from each other in a left-to-right direction. The rotatable member 62 includes two vertical pivot walls 621 respectively adjacent to outer side surfaces of the sidewalls 611. The pivot walls 621 are connected respectively and pivotally to the sidewalls 611 by a pivot pin unit including two pivot pins 622. In this embodiment, each of the pivot pins 622 is a rivet. As such, the rotatable member 62 is rotatable relative to the fixed member 61 about the pivot pins 622. The motion transmitting device 6 further includes two cranks 63 and two links 64. The two cranks 63 have upper ends 631 connected respectively and pivotally to left and right sides of the rotatable member 61, and lower ends 632. In this embodiment, the upper end 631 of each of the cranks 63 is formed with a pivot hole 633. The rotatable member 62 includes a pivot rod 623 extending through the pivot walls 621 and into the pivot holes 633 in the cranks 63, respectively. As such, the cranks 63 are rotatable relative to the rotatable member 62 about the pivot rod 623, and the position of the pivot rod 623 relative to the fixed member 61 can be changed by rotating the rotatable member 62 relative to the fixed member 61.

Each of the links 64 has a first pivot portion 641 connected pivotally to the corresponding pedal rod 5, a second pivot portion 642 disposed above the first pivot portion 641 and connected pivotally to the upright rod portion 22 of the corresponding swing rod 2, and a third pivot portion 643 spaced apart from the second pivot portion 642 and connected pivotally to the lower end 632 of the corresponding crank 63. Each of the pedal rods 5 has a pivot rod portion 51 connected pivotally to the first pivot portion 641 of the corresponding link 64 at a front end thereof, and a pedal portion 52 disposed behind and connected to the pivot rod portion 51 and having a bottom end provided with a sliding wheel 53 slidable forwardly and rearwardly on the top surface of the corresponding supporting rod 4, such that the corresponding pedal rod 5 is rotatable about a central axis of the sliding wheel 53. As such, when the rotatable member 62 is rotated relative to the fixed member 61, the links 64 are driven respectively by the cranks 63 to pivot forwardly or rearwardly to change travel of the pedal portions 52 of the pedal rods 5, thereby adjusting the user's stride.

Figure 4:
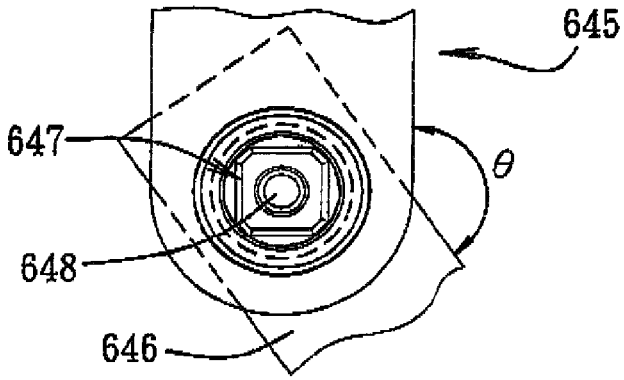
FIG. 4 is a fragmentary schematic view of a link of the first preferred embodiment.

With further reference to FIG. 4, in this embodiment, each of the links 64 includes an inverted L-shaped first rod member 644 and a second rod member 645. Each of the first rod members 644 includes a lower rod body 646 having the first pivot portion 641 at a bottom end thereof, and an upper rod body constituting the second pivot portion 542 and extending perpendicularly from a top end portion of the lower rod body 646. The upright rod portion 22 of each of the swing rods 2 is formed with a horizontal pivot hole 221 permitting the second pivot portion 642 of the corresponding link 64 to extend therethrough, so that the corresponding link 64 can rotate relative to the corresponding upright rod portion 22. The second rod member 645 of each of the links 64 has the third pivot portion 643 at an upper end thereof, and a non-circular horizontal engaging hole 647 at a bottom end thereof. An engaging block 648 is disposed fixedly on an end of each of the second pivot portions 642, has a non-circular cross-section, and is received fittingly within the engaging hole 647 in the corresponding second rod member 645, so that the corresponding second pivot portion 642 is connected fixedly to the bottom end of the corresponding second rod member 645. As such, when the second rod members 645 are activated respectively by the cranks 53, the first rod members 644 co-rotate respectively with the second rod members 645. In this embodiment, the first and second rod members 644, 645 of each of the links 64 form an angle θ therebetween. The angle θ is an obtuse angle.

Figure 5:
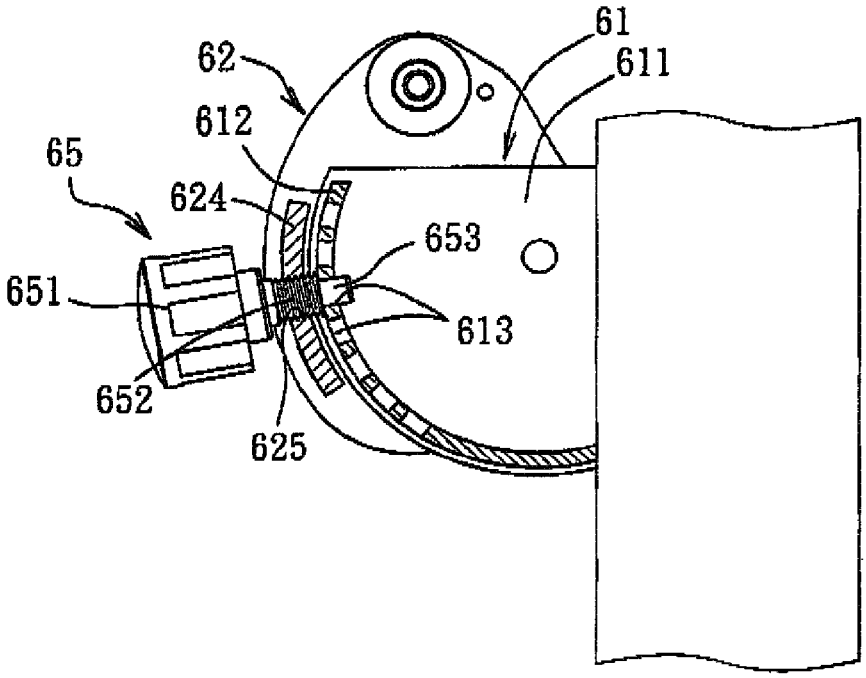
FIG. 5 is a schematic side view of a fixed member, a rotatable member, and a locking member of the first preferred embodiment, illustrating that the rotatable member is disposed at a first angular position.

With further reference to FIG. 5, the fixed member 61 further includes a curved wall 612 interconnecting the sidewalls 611, and the rotatable member 62 further includes a curved wall 624 interconnecting the pivot walls 621. A positioning unit is disposed for maintaining the rotatable member 62 at a desired position relative to the fixed member 61. The positioning unit includes a plurality of curvedly arranged positioning holes 613, a through hole 625, and a locking member 65. The positioning holes 613 are formed through the curved wall 612, are vertically spaced apart from each other, and are spaced apart from a common axis of the pivot pins 622 by the same distance (i.e., the positioning holes 613 are arranged in a circumferential direction with respect to the common axis of the pivot pins 622). The through hole 625 is formed in the curved wall 624 of the rotatable member 62. The locking member 65 extends through the through hole 625 in the rotatable member 62 to engage a selected one of the positioning holes 613 in the fixed member 61, thereby locking the rotatable member 62 releaseably on the fixed member 61 at a selected one of a plurality of angular positions.

In this embodiment, the through hole 625 in the rotatable member 62 is a threaded hole. The locking member 65 has a rotary knob portion 651 exposed outwardly of the rotatable member 62 for manual operation, a threaded rod portion 652 engaging the through hole 625 in the rotatable member 62 and having an end connected to the rotary knob portion 651, and an engaging rod portion 653 connected to an opposite end of the threaded rod portion 652 and engaging the selected positioning hole 613 in the fixed member 61 to lock the rotatable member 62 on the fixed member 61. The rotary knob portion 651 can be operated to remove the engaging rod portion 653 from the selected positioning hole 613 to thereby release the rotatable member 62 from the fixed member 61.

One of the swing rods 2, one of the supporting rods 4, one of the pedal rods 5, one of the cranks 63, and one of the links 64 at the same side (i.e., the left side) will be described in the succeeding paragraphs.

Figure 6:
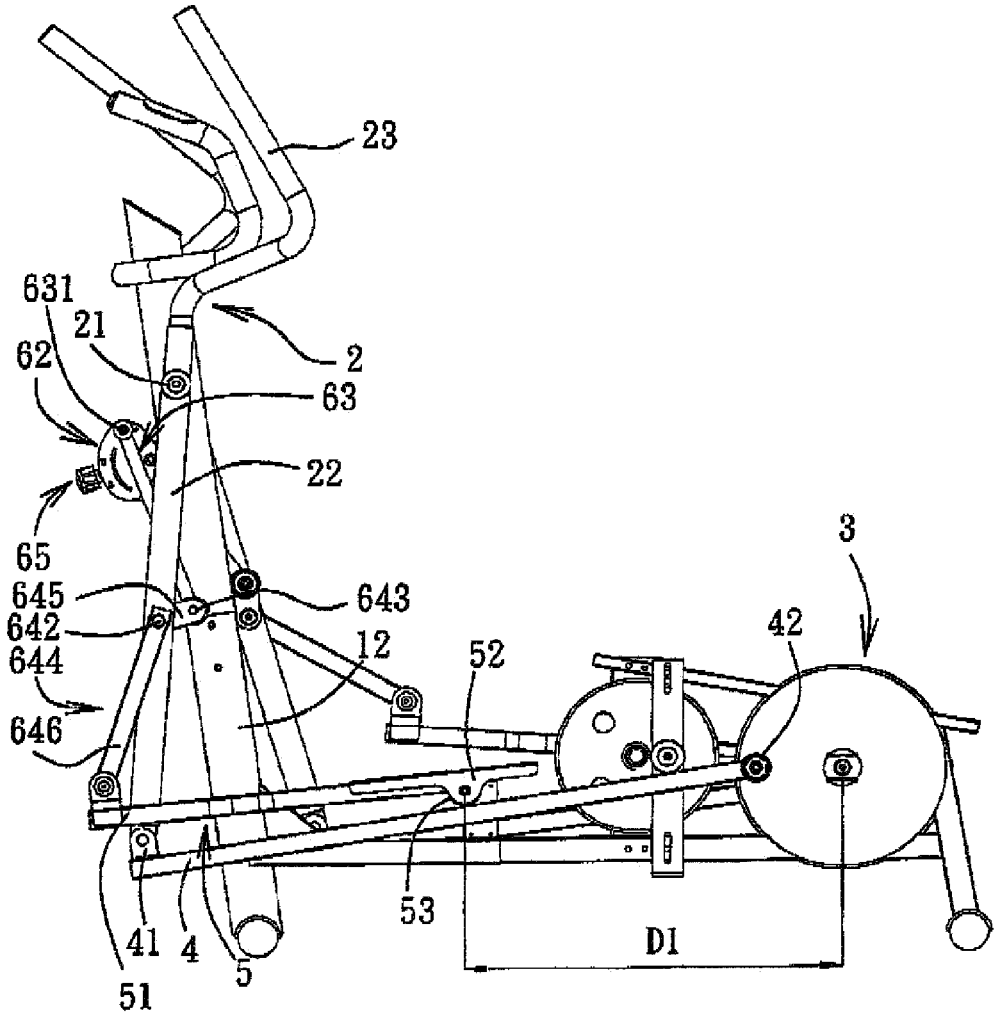
FIGS. 6 and 7 are side views of the first preferred embodiment, illustrating respectively maximum and minimum distances between centers of a sliding wheel and a flywheel when the rotatable member is disposed at the first angular position.
Figure 7:
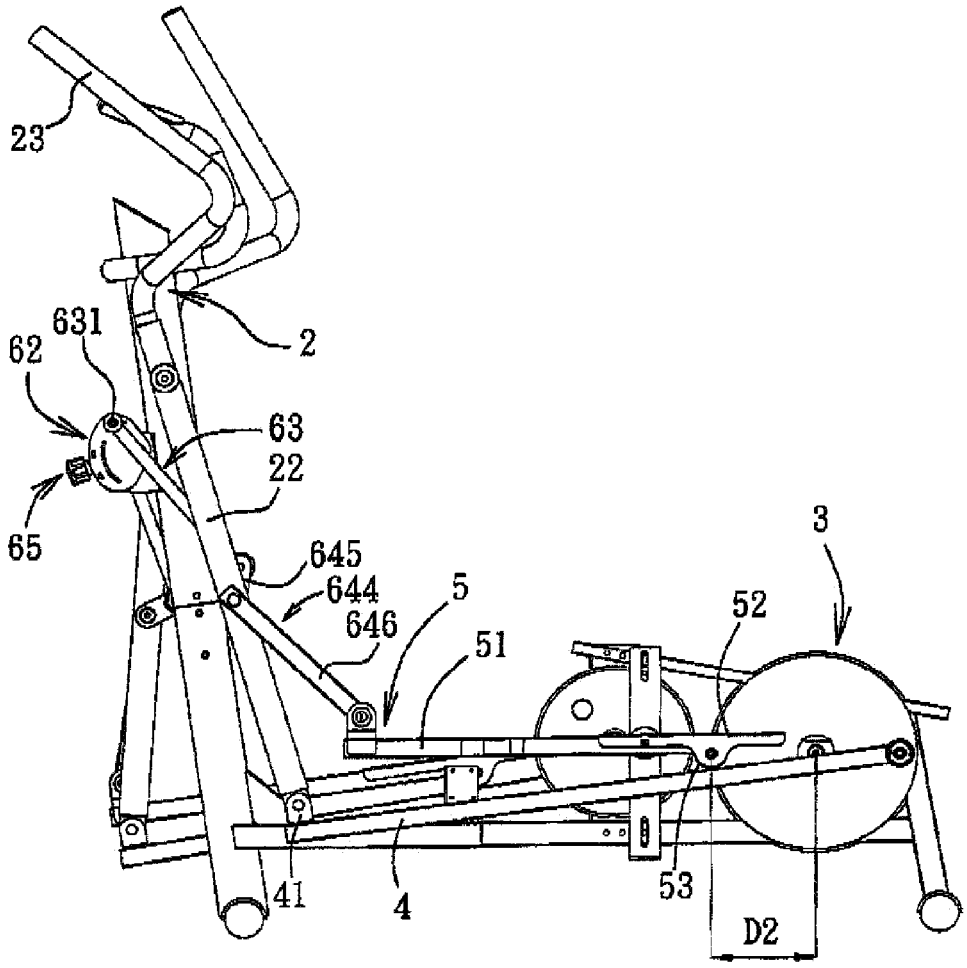

With particular reference to FIGS. 5, 6, and 7, when the locking member 65 is inserted into the third (counted from the top) positioning hole 613 so that the rotatable member 62 is disposed at a first angular position, as shown in FIG. 5, each of the pedal rods 5 is movable between a front limit position whereat the centers of the sliding wheel 53 the flywheel 3 are spaced apart from each other by a maximum distance (D1) (see FIG. 6), and a rear limit position shown in FIG. 7 whereat the centers of the sliding wheel 53 and the flywheel 3 are spaced apart from each other by a minimum distance (D2) (see FIG. 7). When the rotatable member 62 is disposed at the first angular position, D1 is 578 mm, and D2 is 163 mm. As a consequence, the travel of the pedal portion 52 is D1−D2=578 mm−163 mm=415 mm (approximately 16 inches).

Figure 8:
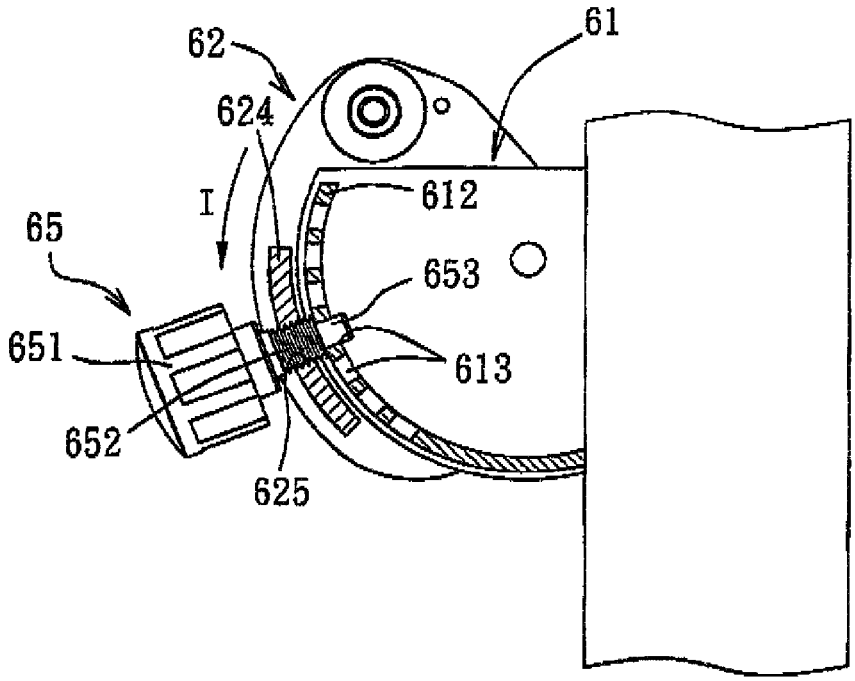
FIG. 8 is a schematic side view of the fixed member, the rotatable member, and the locking member of the first preferred embodiment, illustrating that the rotatable member is disposed at a second angular position.
Figure 9:
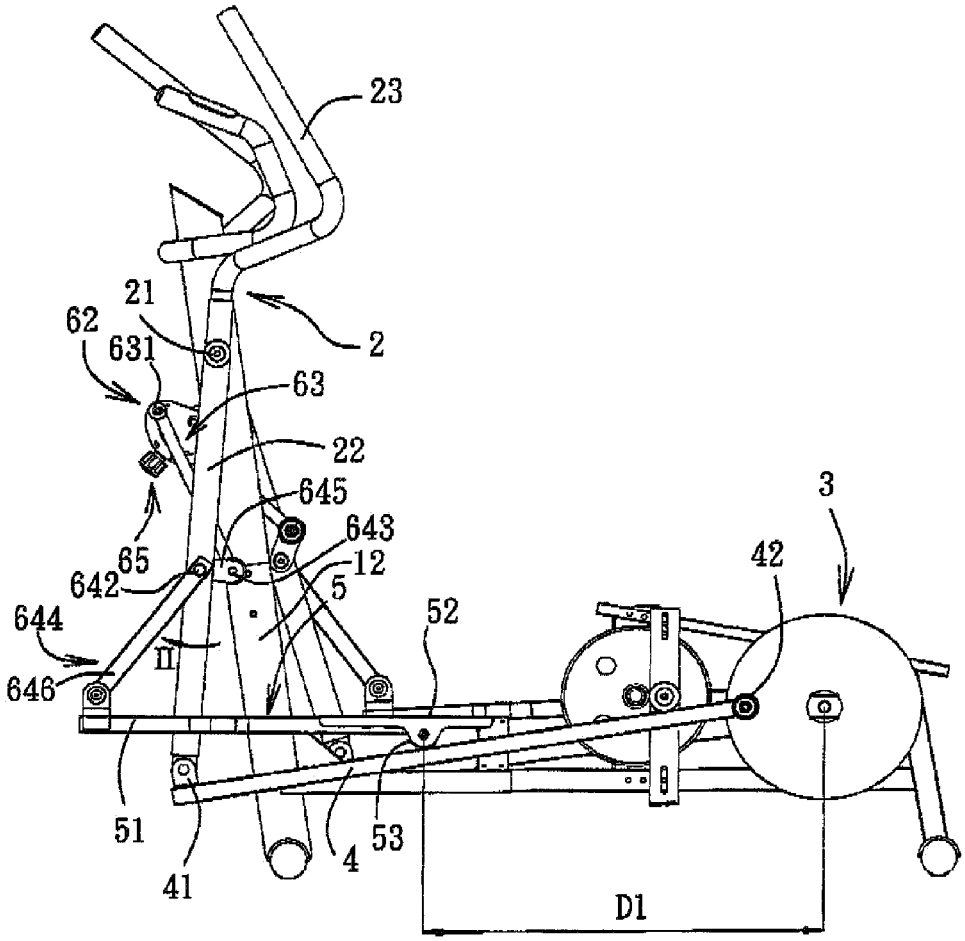
FIGS. 9 and 10 are side views of the first preferred embodiment, illustrating respectively maximum and minimum distances between centers of the sliding wheel and the flywheel when the rotatable member is disposed at the second angular position.
Figure 10:
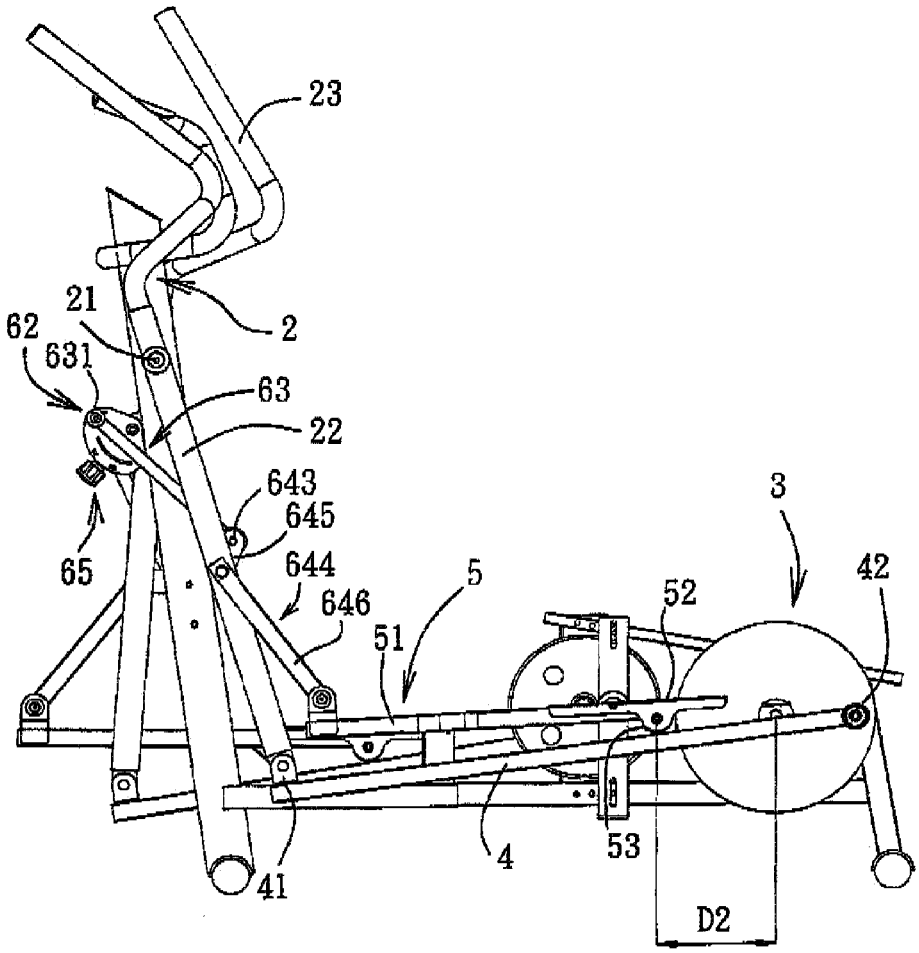

With particular reference to FIGS. 8, 9, and 10, when it is desired to slightly increase the travel of the pedal rod 5, the locking member 65 is first operated to separate from the third positioning hole 613. Next, the rotatable member 62 is rotated relative to the fixed member 61 in a counterclockwise direction (I) (see FIG. 8) to align the locking member 65 with the fourth (counted from the top) positioning hole 613. Afterwards, the rotary knob portion 651 is operated to engage the engaging rod portion 653 with the fourth positioning hole 613 to thereby lock the rotatable member 62 on the fixed member 61 at a second angular position. During counterclockwise rotation of the rotatable member 62, the third pivot portion 643 is pivoted downwardly about the second pivot portion 642 to thereby rotate the first rod member 644 in a direction (II), thus moving the pedal rod 5 forwardly on the supporting rod 4. Hence, an angle formed between the link 64 and the upright rod portion 22 of the swing rod 2 and, thus, the travel of the pedal rod 5 are increased. In this embodiment, when the rotatable member 62 is disposed at the second angular position, the travel of the pedal rod 5 is about 17 inches. To reduce the travel of the pedal rod 5, the locking member 65 can be operated to engage the first or second (counted from the top) positioning hole 613.

In this embodiment, when the locking member 65 engages the first positioning hole 613, the travel of the pedal portion 52 is about 14 inches; when the locking member 65 engages the second positioning hole 613, the travel of the pedal portion 52 is about 15 inches; when the locking member 65 engages the fifth positioning hole 613, the travel of the pedal portion 52 is about 18 inches; when the locking member 65 engages the sixth positioning hole 613, the travel of the pedal portion 52 is about 19 inches; and when the locking member 65 engages the seven positioning hole 613, the travel of the pedal portion 52 is about 20 inches.

Alternatively, the number and positions of the positioning holes 613 may be changed. In addition, the positioning holes 613 may be replaced with a plurality of positioning grooves. If this occurs, the rotatable member 62 may be provided with a spring-biased engaging member or ball that is engageable within a selected one of the positioning grooves.

Figure 11:
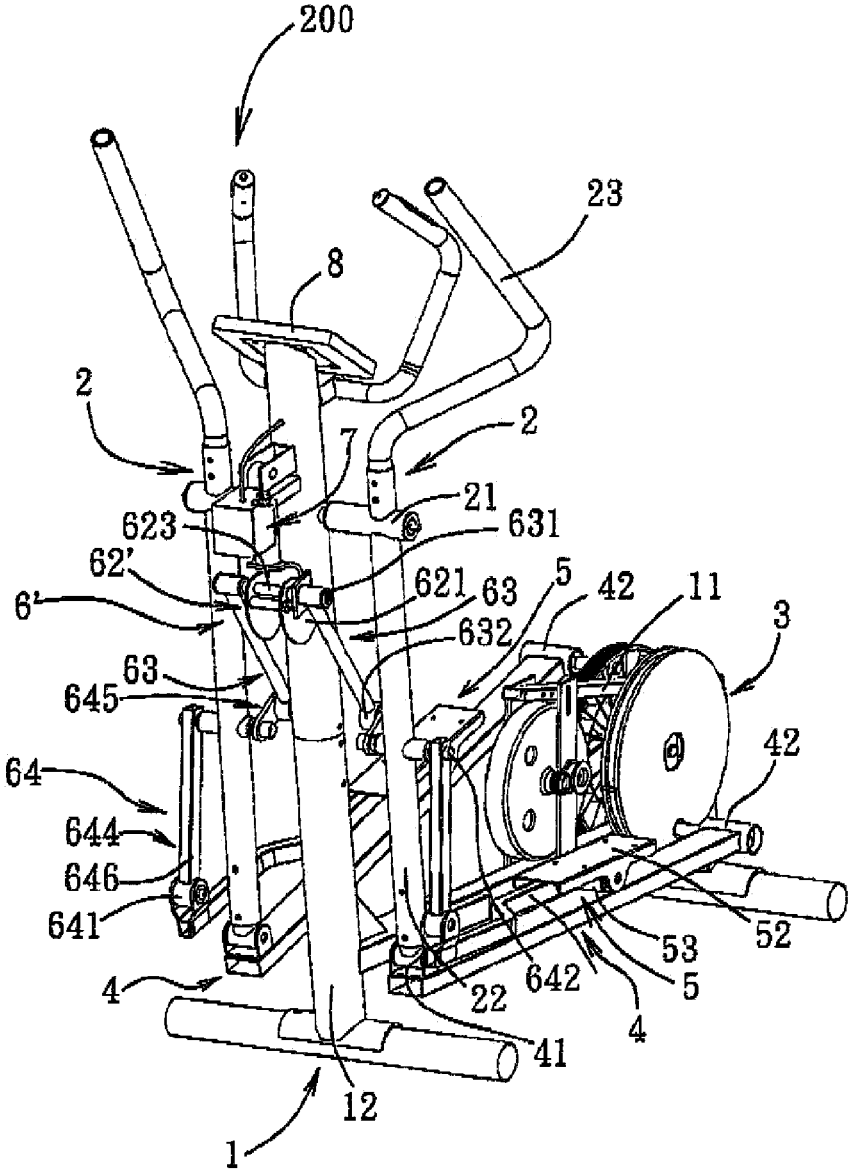
FIG. 11 is a perspective view of the second preferred embodiment of a stride adjustable elliptical exercise machine according to this invention.
Figure 12:
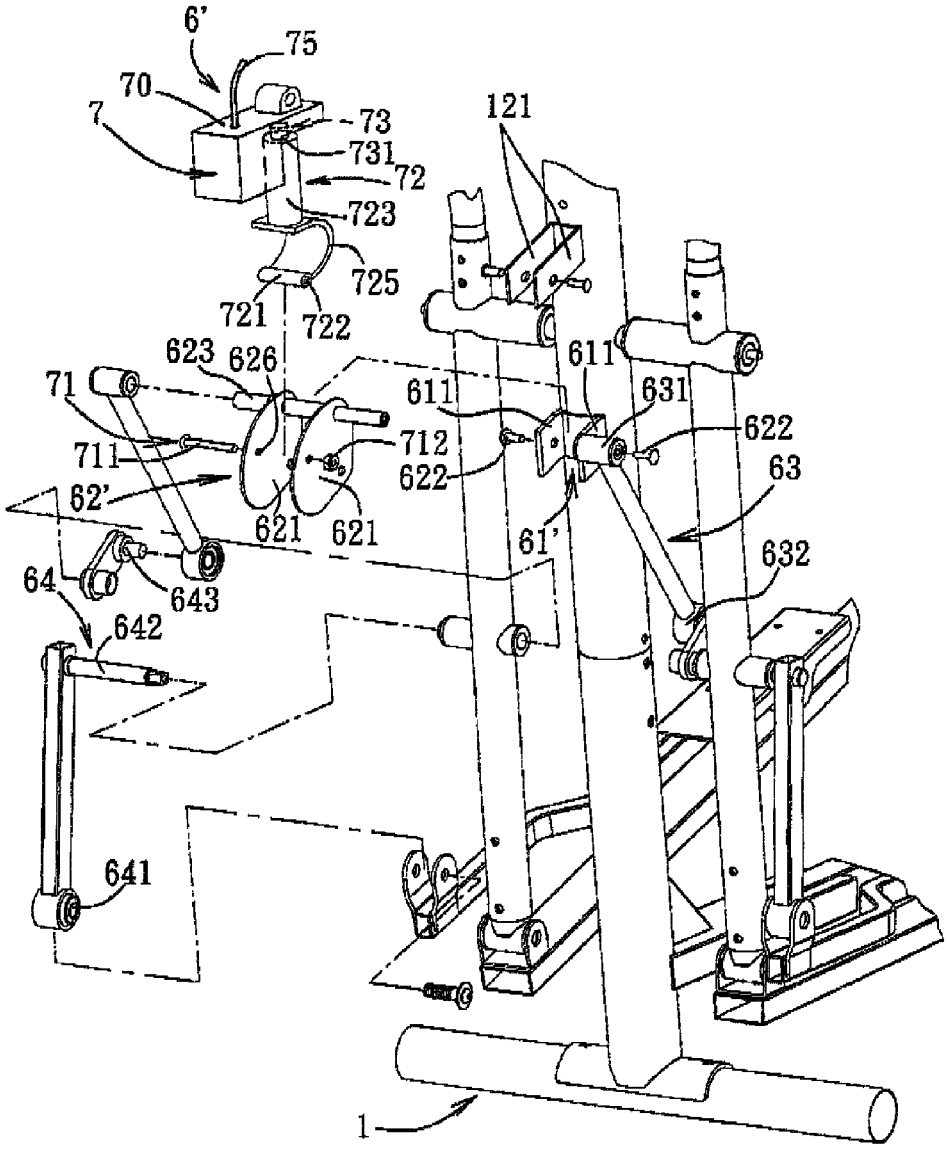
FIG. 12 is a partly exploded perspective view of the second preferred embodiment.
Figure 13:
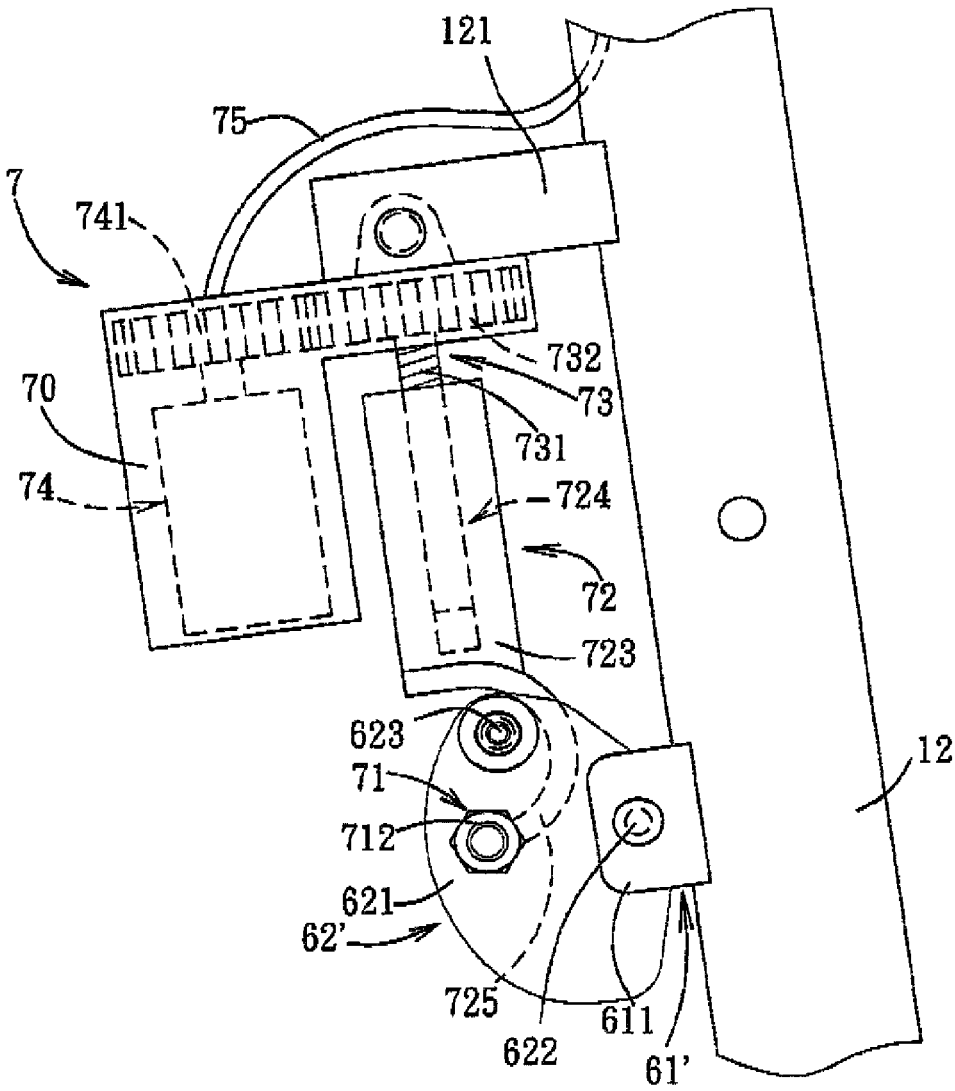
FIG. 13 is a fragmentary schematic side view of the second preferred embodiment.

FIGS. 11, 12, and 13 show the second preferred embodiment of a stride adjustable elliptical exercise machine 200 according to this invention, which is similar in construction and operation to the first preferred embodiment except for the motion transmitting device 6'.

The motion transmitting device 6' further includes a driving mechanism 7 for driving rotation of the rotatable member 62' relative to the fixed member 61', and a control module 8 disposed on a top end of the post 12 of the base 1 and electrically connected to the driving mechanism 7 such that travel of the pedal portions 52 of the pedal rods 5 can be adjusted through operation of the control module 8.

The driving mechanism 7 is located above the fixed member 61', and includes a housing 70 disposed fixedly between two supporting plate portions 121 of a U-shaped bracket that is secured on the post 12. The driving mechanism 7 further includes a horizontal pivot shaft 71 disposed on the rotatable member 62', and a movable member 72 having a bottom end sleeved rotatably on the pivot shaft 71. The pivot shaft 71 includes a bolt 711 and a nut 712 engaging the bolt 711. The bolt 711 extends through holes 626 in the pivot walls 621 and a hole 722 in a bottom end sleeve portion 721 of the movable member 72. The nut 712 engages an end of the bolt 711, and abuts against one of the pivot walls 621 for locking the bolt 711 on the rotatable member 62'. As such, the movable member 72 is rotatable about the pivot shaft 71.

The driving mechanism 7 further includes a stud 73 and a driving motor 74. The stud 73 has a threaded rod portion 731 extending rotatably through the housing 70 so that the stud 73 is rotatable relative to the base 1, and a gear portion 732 disposed on a top end of the threaded rod portion 731 and in the housing 70. A rod body 723 of the movable member 72 is formed with a threaded hole 724 that is open outwardly and that engages the threaded rod portion 731 of the stud 73. As such, the stud 73 engages threadably a top end of the movable member 72. The driving motor 74 is disposed within the housing 70, and includes a driving gear 741 meshing with the gear portion 732 of the stud 73. A transmission line 75 is disposed for connecting the driving motor 74 electrically to the control module 8. The control module 8 is operable to activate the driving motor 74 so as to drive rotation of the stud 73 in a positive or reverse direction, thereby resulting in downward or upward movement of the rod body 723 of the movable member 72. When the rod body 723 of the movable member 72 is moved downwardly, the movable member 72 pushes downwardly and rotates the rotatable member 62' relative to the fixed member 61' about the pivot pins 622 in a counterclockwise direction to increase the travel of the pedal portions 52 of the pedal rods 5. When the rod body 723 of the movable member 72 is moved upwardly, the movable member 72 pulls upwardly and rotates the rotatable member 62' relative to the fixed member 61' about the pivot pins 622 in a clockwise direction to reduce the travel of the pedal portions 52 of the pedal rods 5.

The movable member 72 further includes a curved plate body 725 extending from a bottom end of the rod body 723. The sleeve portion 721 is disposed at a bottom end of the curved plate body 725. Since the curved plate body 725 is resilient, rotational angle of the rotatable member 62' can be increased, and the distance traveled by the rod body 723 of the movable member 72 can be reduced.

Figure 14:
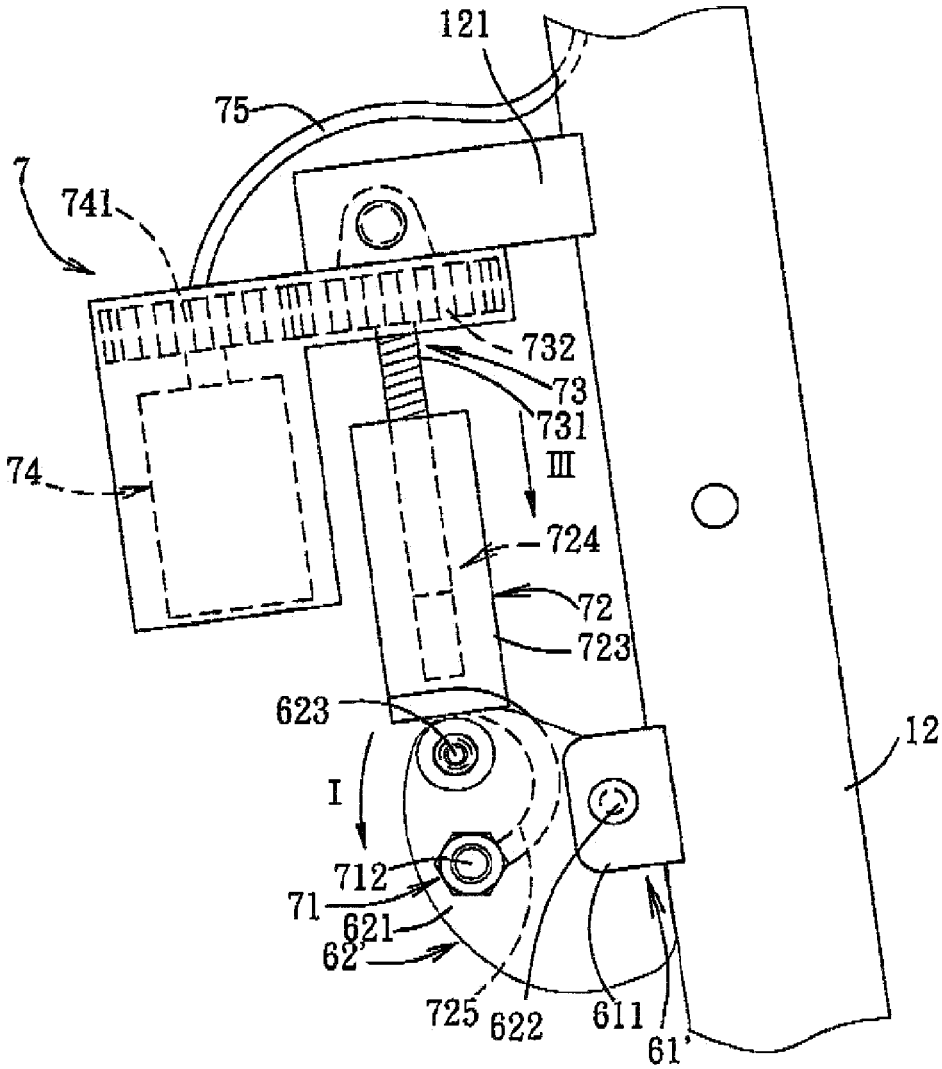
FIG. 14 is a view similar to FIG. 13 but illustrating how a rotatable member is rotated counterclockwise relative to a fixed member.
Figure 15:
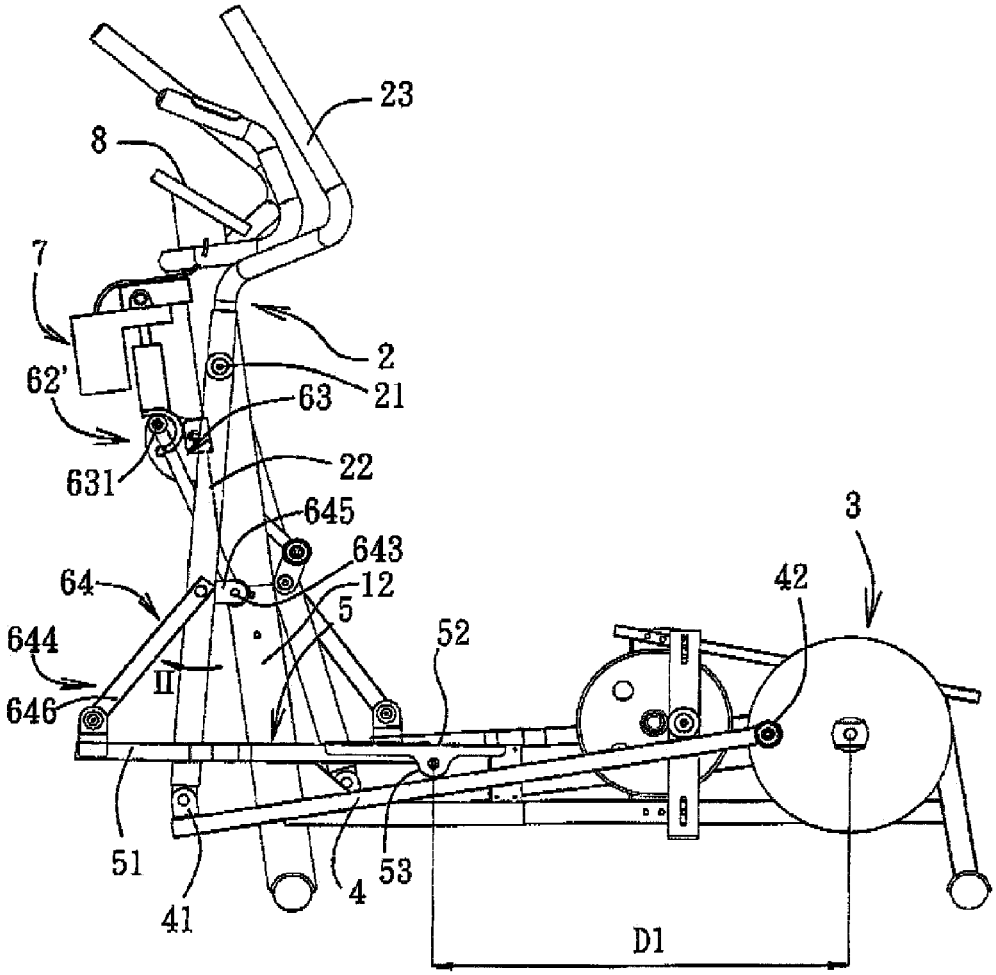
FIGS. 15 and 16 are side views of the first preferred embodiment, illustrating respectively maximum and minimum distances between centers of a sliding wheel and a flywheel when the rotatable member is disposed at an angular position.
Figure 16:
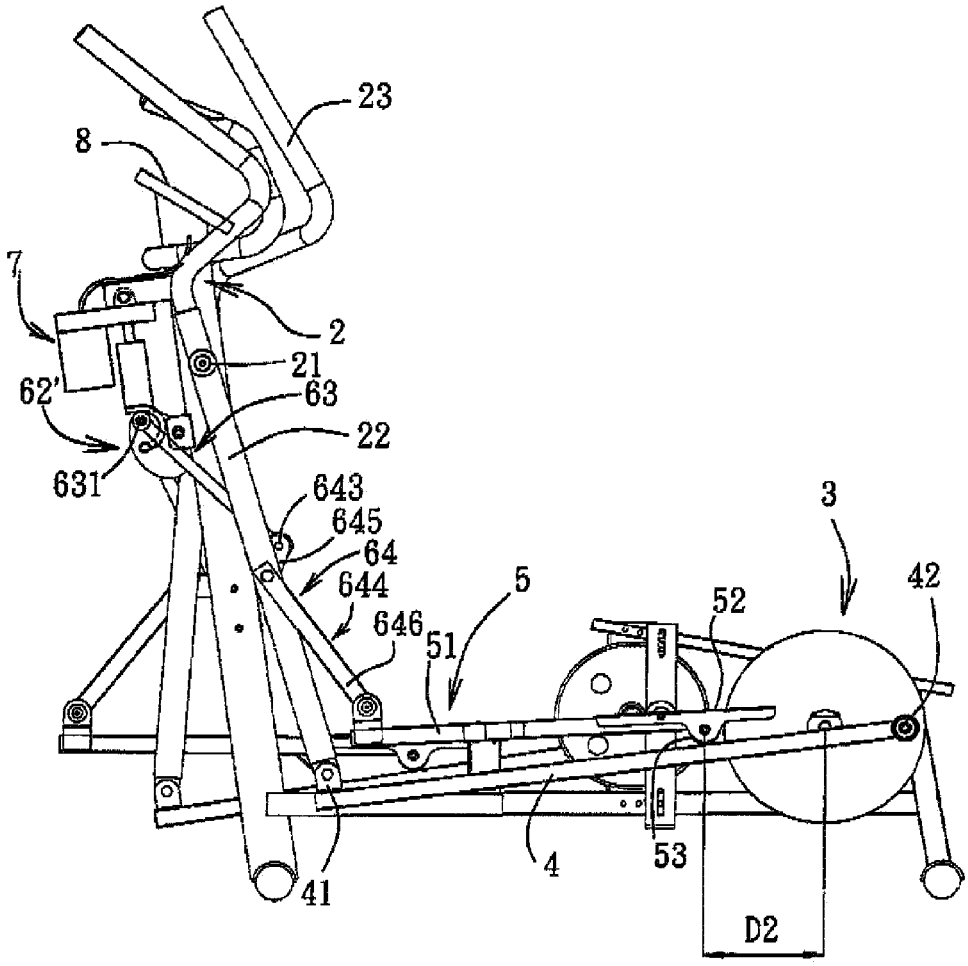

Referring to FIGS. 14, 15, and 16, when it is desired to increase travel of the pedal portions 52 of the pedal rods 5, through operation of the control module unit 8, a control signal is emitted from the control module unit 8 to the driving mechanism 7 via the transmission line 75, such that the driving motor 74 is activated to drive positive rotation of the stud 73. During positive rotation of the stud 73, the rod body 723 of the movable member 72 is moved downwardly in a direction (III) (see FIG. 14), so that the curved plate body 725 cooperates with the sleeve portion 721 and the pivot shaft 71 to rotate the rotatable member 62' relative to the fixed member 61' about the pivot pins 622 in a counterclockwise direction (I) (see FIG. 14), thereby resulting in rotation of the link 64 about a central axis of the second pivot portion 642 of the link 64 in a clockwise direction (II) (see FIG. 15) and forward movement of the pedal rod 5. Consequently, travel of the pedal portions 52 of the pedal rods 5 is increased.

When it is desired to reduce travel of the pedal portions 52 of the pedal rods 5, through operation of the control module unit 8, a control signal is emitted from the control module unit 8 to the driving mechanism 7 via the transmission line 75, such that the driving motor 74 is activated to drive reverse rotation of the stud 73. During reverse rotation of the stud 73, the rod body 723 of the movable member 72 is moved upwardly, so that the curved plate body 725 cooperates with the sleeve portion 721 and the pivot shaft 71 to rotate the rotatable member 62' relative to the fixed member 61' about the pivot pins 622 in a clockwise direction (I), thereby resulting in rotation of the link 64 about the central axis of the second pivot portion 642 of the link 64 in a counterclockwise direction and rearward movement of the pedal rod 5. Consequently, travel of the pedal portions 52 of the pedal rods 5 is reduced.

In view of the above, the elliptical exercise machine 100, 200 of this invention has a simple structure, and is easy and convenient to adjust the stride. Thus, the object of this invention is achieved.

With this invention thus explained, it is apparent that numerous modifications and variations can be made without departing from the scope and spirit of this invention. It is therefore intended that this invention be limited only as indicated by the appended claims.

I claim:

1. An elliptical exercise machine comprising:

a base;

two swing rods connected pivotally to said base and spaced apart from one another in a left-to-right direction;

a flywheel disposed rotatably on said base;

two supporting rods connected respectively to bottom ends of said swing rods and connected pivotally to said flywheel;

two pedal rods disposed fixedly on said base, a rotatable member disposed rotatably on said fixed member and locked releasably on said fixed member at a selected one of a plurality of angular positions;

two cranks having upper ends connected respectively and pivotally to left and right sides of said rotatable member, and lower ends opposite to said upper ends, and two links each having a first pivot portion connected pivotally to a respective one of said pedal rods, a second pivot portion disposed above and said first pivot portion and connected pivotally to a respective one of said swing rods, and a third pivot portion spaced apart from said second pivot portion and connected pivotally to said lower end of a respective one of said cranks, said links being driven by said cranks to move said pedal rods forwardly and rearwardly on said supporting rods, respectively.

2. The elliptical exercise machine as claimed in claim 1, wherein:

said fixed member has a plurality of curvedly arranged positioning holes vertically spaced apart from each other;

said rotatable member has a through hole; and said motion transmitting device further includes a locking member extending through said through hole in said rotatable member to engage a selected one of said positioning holes in said fixed member, thereby locking said rotatable member at the selected one of the angular positions.

3. The elliptical exercise machine as claimed in claim 2, wherein each of said links includes and inverted L-shaped first rod member and having said first and second pivot portions, and a second rod member having the third pivot portion at an upper end thereof and connected fixedly to said first rod member.

4. The elliptical exercise machine as claimed in claim 3, wherein each of said swing rods has a pivot hole such that said second pivot portion of said first rod member of a corresponding on of said links extends through said pivot hole to connect with a lower end of a corresponding one of said second rod members of said links.

5. The elliptical exercise machine as claimed in claim 2, wherein said motion transmitting device further includes a pivot pin unit extending into said rotatable member pivotally to said fixed member, and said fixed member further includes a curved wall, said positioning holes being formed through said curved wall and being spaced apart from said pivot pin unit by the same distance.

6. The elliptical exercise machine as claimed in claim 1, wherein said through hole in said rotatable member is a threaded hole, said locking member having a rotary knob portion exposed outwardly of said rotatable member for manual operation, a threaded rod portion engaging said through hole and having an end connected to an opposite end of said threaded rod portion and engaging the selected one of said positioning holes in said fixed member.

7. The elliptical exercise machine as claimed in claim 1, wherein said motion transmitting device further includes a driving mechanism disposed on said base for driving rotation of said rotatable member relative to said fixed member, and a control module disposed on said base and electrically connected to said driving mechanism and operable for activating said driving mechanism.

8. The elliptical exercise machine as claimed in claim 7, wherein said driving mechanism includes a pivot shaft disposed on said rotatable member, a movable member having a bottom end connected to said pivot shaft, a stud disposed rotatably on said base and engaging threadably a top end of said movable member so as to allow for relative movement between said stud and said movable member, and a driving motor electrically connected to said control module and operable for driving rotation of said stud.

9. The elliptical exercise machine as claimed in claim 8, wherein said movable member includes a rod body formed with a threaded hole engaging said stud, and a resilient curved plate body extending from a bottom end of said rod body and having a sleeve portion disposed at a bottom end of said curved plate body and sleeved rotatably on said pivot shaft, said driving motor being activated by said control module to drive rotation of said stud on said rotatable member to thereby move said rod body of said movable member relative to said stud and rotate said sleeve portion about said pivot shaft.

* * * * *